US006588975B2

(12) United States Patent
Ross

(10) Patent No.: US 6,588,975 B2
(45) Date of Patent: Jul. 8, 2003

(54) MOLDED ASPHALT SURFACING SYSTEM

(76) Inventor: Guy Ross, 2446 Bank St., #304, Ottawa, Ontario (CA), K1V 1A8

( * ) Notice: Subject to any disclaimer, the term of this patent is extended or adjusted under 35 U.S.C. 154(b) by 64 days.

(21) Appl. No.: 10/002,105

(22) Filed: Dec. 5, 2001

(65) Prior Publication Data

US 2002/0076278 A1 Jun. 20, 2002

(51) Int. Cl.[7] ..... E01C 7/06; E01C 23/16; B05D 3/00; B05D 5/00; E04B 1/16

(52) U.S. Cl. ..... 404/75; 404/89; 404/93; 427/272; 427/278; 249/188; 249/203; 264/34

(58) Field of Search ..... 404/18, 72, 75, 404/89, 93; 427/272, 278, 282; 249/2, 188, 203, 207; 264/31, 34

(56) References Cited

U.S. PATENT DOCUMENTS 2,595,142 A * 4/1952 Herck ..... 264/31
D272,037 S * 1/1984 Puccini ..... D8/45
5,215,402 A * 6/1993 Stowell et al. ..... 404/93
5,487,526 A * 1/1996 Hupp ..... 249/2
5,494,372 A * 2/1996 Oliver et al. ..... 404/72
5,502,941 A * 4/1996 Zember et al. ..... 52/314
6,382,871 B1 * 5/2002 Ross ..... 404/75

* cited by examiner

*Primary Examiner*—Gary S. Hartmann
(74) *Attorney, Agent, or Firm*—Ronald G. Bitner

(57) ABSTRACT

A system for molding a design onto a surface comprising providing an asphalt molding mesh comprising pattern molding elements formed of a flexible material having a generally V-shaped cross-section in a configuration corresponding to a pattern to be molded in the asphalt, wherein the molding mesh is in the form of an open mesh, defining open spaces between the molding elements; positioning the molding mesh onto the surface and depositing hot asphalt into the open spaces between the molding elements and levelling the asphalt, and then rolling over the mesh and asphalt to mold and compact the asphalt about the mesh and facilitate adherence to the underlying surface, and, after rolling, removing the molding mesh from the asphalt.

10 Claims, 2 Drawing Sheets

MOLDED ASPHALT SURFACING SYSTEM

FIELD OF THE INVENTION

This invention relates to a system for molding a design with hot moldable asphalt onto a surface.

BACKGROUND OF THE INVENTION

The aesthetic appearance of roads, parking lots and driveways, particularly those made of asphalt, can be improved by providing a pattern or design on the surface, which for example, can be made to resemble brick, cobblestone, stone, or the like.

Various methods for imprinting asphalt or concrete have been attempted, or proposed. For example, U.S. Pat. Nos. 3,832,079 and 3,910,711 to Moorhead describe a concrete or paving forming apparatus and process whereby a roller forms a pattern in the pavement and an intervening sheet of plastic film is said to prevent binding and gouging of the pavement surface. U.S. Pat. No. 4,105,354 to Bowman shows a wheel-like imprinting device having blades on a circular frame, and is propelled and ballasted by a person. U.S. Pat. No. 5,215,402 to Stowell & Zaseybida describes a grid-like "template", comprising cables, that is progressively compressed into, and lifted from, the previously rolled asphalt surface. This method is labor intensive and leaves many defects caused by the multiple seams and also by the process of compressing with rollers or plates. Furthermore, the round cable, due to the shape, tends to shift making non-uniform patterns. The slower process also causes problems with maintaining proper temperature of the asphalt. With this proposal if the temperature of the asphalt is too hot, it is difficult to prevent the template from sinking and getting buried in the asphalt resulting in damage to the surface when removed, and if the asphalt is too cold, it is difficult to imprint the asphalt. Because of this, it is difficult to insert the template to a uniform depth. Also, the cable is difficult to remove from the asphalt due to the cross-sectional shape of the cable and the shape of the impression that it produces.

U.S. Pat. No. 6,024,511, to Ross, discloses an apparatus for imprinting a pattern on the surface of asphalt comprising an endless belt having pattern forming elements mounted on a pair of rollers, and a weighted roller for pressing the belt into the asphalt. This apparatus is suitable for imprinting regularly repeating patterns over a considerable length, but is not well suited for imprinting smaller or non-repeating patterns, such as circular or other non-linear patterns.

Co-pending U.S. patent application Ser. No. 09/619,443 to Ross discloses a system for molding a pattern on the surface of heated asphalt that involves inserting a mesh into previously laid asphalt and then rolling over the mesh and asphalt to mold the asphalt and compact the asphalt about the mesh.

SUMMARY OF THE INVENTION

An object of the present invention is to provide a relatively simple system for applying a molded pattern of asphalt onto a surface.

It has been found that a pattern can be applied onto a surface by a system utilizing a flexible molding mesh, preferably made of elastic material, depositing hot moldable asphalt to the open spaces of the mesh and rolling to compact and mold the the deposited asphalt about the mesh.

The present invention provides a system for molding a design onto a surface comprising: providing an asphalt molding mesh comprising pattern molding elements formed of a flexible material having a generally V-shaped cross-section in a configuration corresponding to a pattern to be molded in the asphalt, wherein the molding mesh is in the form of an open mesh, defining open spaces between the molding elements; positioning the molding mesh onto the surface; depositing hot asphalt into the open spaces between the molding elements, and levelling the asphalt; rolling over the mesh and asphalt to facilitate adherence of the asphalt to the surface and to mold and compact the asphalt about the mesh; applying water to the surface of the asphalt while rolling to limit the heating and buckling, and sticking of the mesh; and, after rolling removing the molding mesh from the asphalt.

DESCRIPTION OF THE PREFERRED EMBODIMENTS

Figure 1:
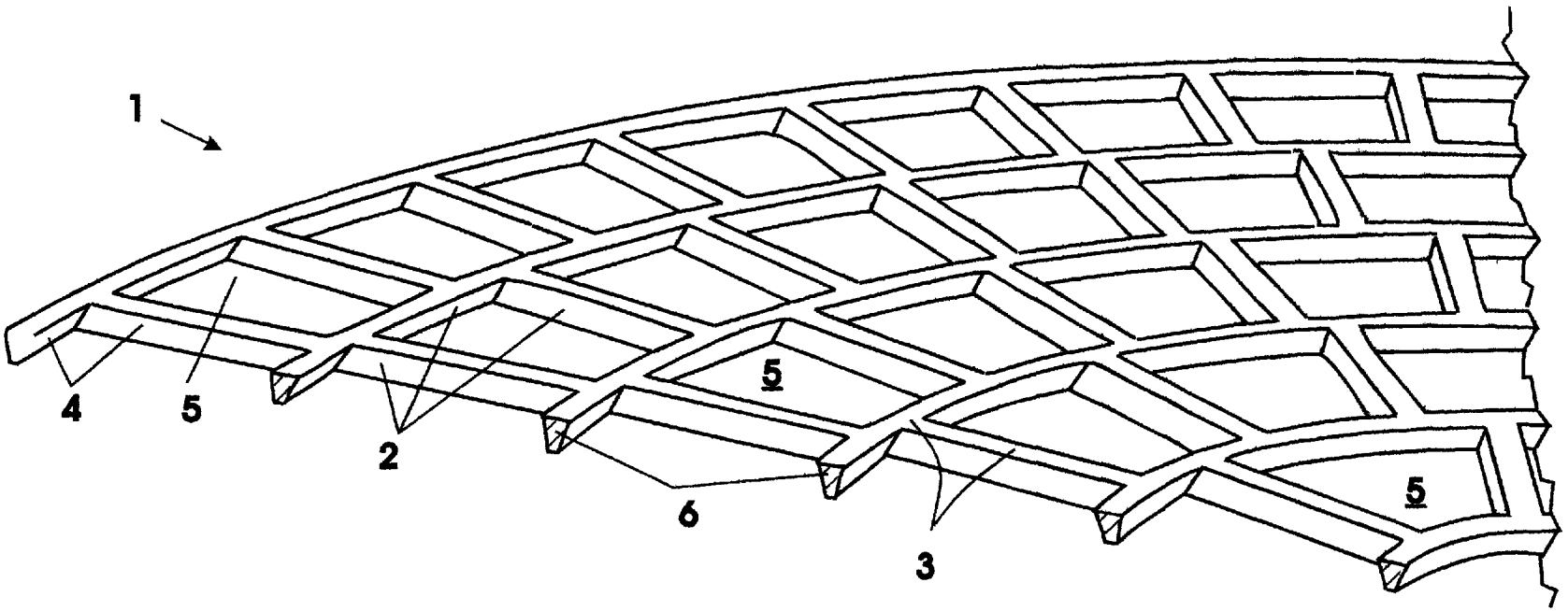
FIG. 1 is a perspective view of one embodiment of an asphalt molding mesh for the present invention.
Figure 2A:
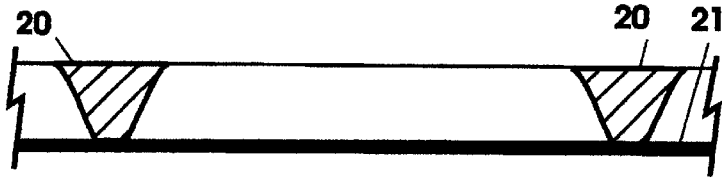
FIG. 2 is a schematic representation of the operation of the system, illustrating various steps 2(*a*), 2(*b*), 2(*c*), 2(*d*) and 2(*e*) of the operation.
Figure 2B:
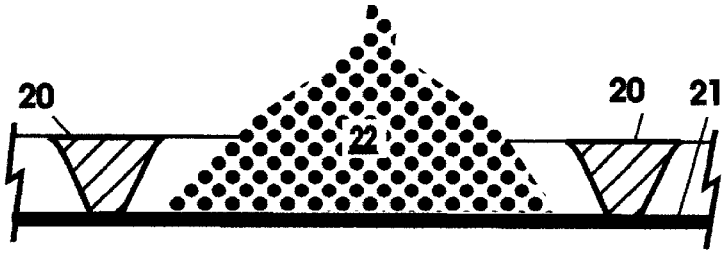
Figure 2C:
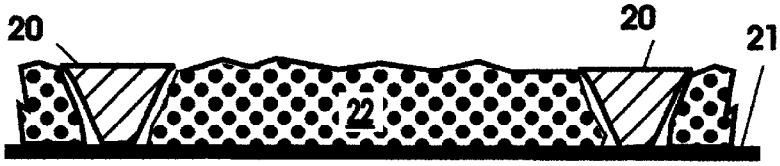
Figure 2D:
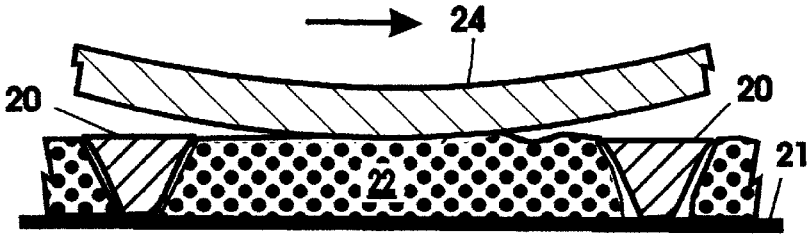
Figure 2E:
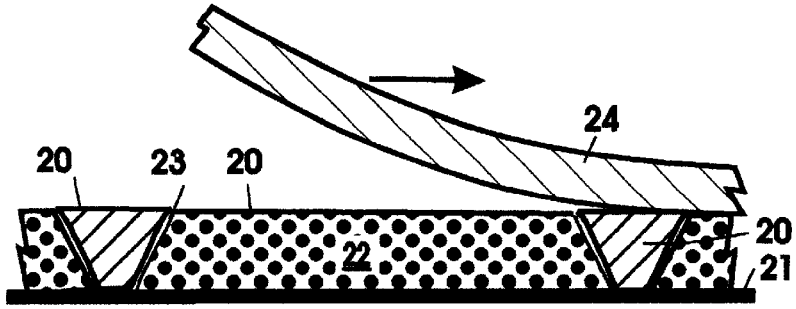

With reference to FIG. 1, the present invention utilises an asphalt molding mesh 1 formed of an elastic material having pattern molding elements 2 in a configuration corresponding to a pattern to be molded into the asphalt. The mesh has a generally V-shaped cross-section to facilitate removal from the asphalt. The mesh is provided with a flat upper surface 3 for contact by the roller and converging V-shaped side walls 4. The mesh defines open spaces 5 between the pattern molding elements 2.

The bottom of the 'V' may be truncated, if desired, forming a short flat portion at the bottom. It was found that a mesh with such a shape was easier to fabricate or mold, and the wider bottom portion is more robust than one with a sharp V-shaped bottom.

FIG. 2 shows the mesh 20 placed on a surface 21 and illustrates the various steps of the operation.

In operation, with reference to FIG. 2, and specifically to FIG. 2(*a*) the mesh 20, is placed on a surface 21 which may be any hard surface such as concrete, asphalt, or compacted ground or gravel.

After positioning the molding mesh on the surface, hot asphalt 22 is deposited by suitable means into the open spaces between the molding elements of the mesh 20, as shown in FIG. 2(*b*).

The flat upper surface can be used as a guide for a rake or other suitable levelling tool for levelling the asphalt to the level of the upper surface of the mesh, as shown in FIG. 2(*c*).

With reference to FIG. 2(*d*), after depositing and levelling the asphalt 22, the asphalt is rolled with a suitable roller 24 to compact the asphalt about the mesh and facilitate adherence to the underlying surface. The flat upper surface of the mesh allows repeated rolling over the mesh without dislodging. Repeated rolling also serves to complete and enhance the molding of the pattern as the mesh is repeatedly pushed down by the roller. The open spaces between the pattern molding elements allow compaction and finishing of these regions in a conventional manner.

It should be noted that some unevenness in the depositing of the asphalt may produce an aesthetic advantage for some applications, for example, for providing a more natural appearance for simulating old or worn brick or cobblestone, stone, or the like.

The rolling operation of the present invention will preferably be preformed on freshly deposited hot asphalt prior to cooling. The temperature of the asphalt will typically be from about 225 to 300° F.

Water is supplied to the surface of the asphalt while rolling. The use of water prevents sticking and facilitates limiting temperature rise of the mesh and maintaining it equalized to that of the surface of the asphalt. The application of water limits the temperature rise and the resulting expansion and buckling of the mesh from the heat of lower regions of the asphalt. The water also facilitates the cooling and hardening of the asphalt. It should be noted that water is conventionally used while rolling to prevent sticking of the roller to the asphalt. Therefore, conventional equipment can be conveniently used to apply the proper amounts of water, typically greater amounts, for the purpose of the present invention, as described above.

To avoid the adverse effects of temperature changes, namely buckling due to expansion, it was found that the temperature changes in the molding mesh should be limited to less than about 60° F.

After some rolling and compaction of the asphalt, the mesh can be removed. Preferably, any excess asphalt material on the mesh is removed before removing the mesh to prevent it from falling in the pattern grooves. For a smooth surface finish the surface can be rolled additionally after removal of the mesh. However, for simulating old or worn brick or cobblestone, for example, such additional rolling may be dispensed with.

The generally V-shaped cross-section of the pattern molding elements of the mesh facilitates removal of the mesh after the rolling operation. With the present shape, the widest part of the mesh is at the surface of the asphalt and the narrower side wall portions 24 facilitates release from the asphalt, after the asphalt has cooled and hardened. The flat upper surface of the mesh allows unhindered rolling of the asphalt for compaction of the surface in a conventional manner.

After the rolling operation is completed, cooling causes the molding mesh to contract. The contraction is usually sufficient to cause large portions of the mesh to lift and separate from the asphalt surface, due to the V-shaped cross-section. This lifting and separation provides a convenient indication that the mesh is ready to be removed, and removed easily.

The use of a generally V-shaped mesh cross-section molds a pattern having downwardly sloping sides that is less susceptible to crumbling and damage from freezing of accumulated water. Preferably, as shown in FIG. 2, the top portion will be flared to produce rounded edges along the top of the molded pattern, since a sharp edge would be susceptible to crumbling. Also, the bottom of the 'V' may be truncated to form a short flat portion at the bottom, thus providing a wider bottom portion that is more robust than one with a sharp V-shaped bottom.

The use of an elastic material for the molding mesh facilitates the reduction of the temperature rise and expansion and resulting distortion of the mesh and also facilitates the subsequent removal from the asphalt, as follows. With reference to FIGS. 2(*c*) and 2(*d*), when pushed down by the roller, the elastic mesh elements 20 will expand horizontally against the asphalt to produce a cavity larger than the size of the mesh when the pressure is subsequently released. This larger cavity leaves spaces 23 into which water can penetrate in order to cool the lower submerged region of the mesh, as shown in FIG. 2(*d*). The resulting spaces 23 also facilitates separation and removal of the mesh from the asphalt as described further below.

When the molding and rolling is complete, the molding mesh is removed from the asphalt for subsequent use in another location, as desired. As indicated above, the surface can be rolled further after the mesh is removed to further finish the surface.

The mesh is preferably formed of a deformable material, such as rubber, with a certain degree of elasticity, but little compressibility, so that when pushed down by the roller, it spreads laterally outward whereby the pattern molding elements will be wider than when roller pressure is subsequently released. The use of such an elastic material allows the mesh pattern molding elements to contract slightly when roller pressure is released to provide a clean separation from the asphalt for removal.

A material found to be suitable for the mesh was Buna-N polymer rubber having an ASTM Durometer, type "A", Hardness of 80. It appears that suitable hardness values are in the range of from 50 to 100. The material should be capable of withstanding the elevated temperature of the asphalt surface and the oil and chemicals in the asphalt. It appears that molding mesh dimensions of from ¼ to ¾ inches in depth are suitable.

It should be noted that with the present invention the mesh is placed onto a surface before asphalt is deposited. This provides that upon completion of the operation, with the mesh removed, a grid pattern of crevices is formed with the underlying surface exposed, providing a more realistic simulation of individual bricks or stones placed on a surface.

As indicated above the present invention may be used on any hard surface such as concrete, asphalt, or compacted ground or crushed rock. If resurfacing an older surface, such as asphalt or concrete, the old surface is preferably coated with a suitable adhesive material, such as tar, to enhance adhesion of the deposited asphalt.

If the present invention is used on a non-solid surface, such as crushed rock, the individual molded elements, eg. brick-like elements, will have limited support and may be easily displaced. In order to prevent this, sand may be placed in the crevices between the molded elements to stabilize the elements, similar to the practice used for interlocking brick. Of course, sand may be used in the crevices with any type of underlying surface, for its decorative appearance.

The present invention permits forming a design having an uneven surface, if desired. This can be achieved by providing some mesh portions with elements of different depth.

It will be understood that various types of patterns may be molded, with corresponding changes in the mesh pattern. The pattern may simulate brick, cobblestone, stone, or provide a unique artistic design, or provide text information, such as for displaying parking restrictions. Also, various combinations of mesh units of similar or differing patterns may be interconnected by various means.

It will also be appreciated that pigmented asphalt may be used or that the molded surface produced by the present invention may be treated with a colored sealer, stain, pigment, or other suitable colorant to provide a more realistic simulating effect. With the use of a pigmented sealer, for example, a first coat of one color can be applied to the surface, including the crevices left by the removed mesh, followed by a second coat applied by a suitable roller, for example, that coats only the surface, and not the crevices. Also, different colored asphalt can deposited in different areas of the mesh.

What is claimed is:

1. A system for molding a design of hot moldable asphalt onto a surface comprising:

providing an asphalt molding mesh comprising pattern molding elements formed of a flexible material having a generally V-shaped cross-section in a configuration corresponding to a pattern to be molded in the asphalt, wherein the molding mesh is in the form of an open mesh, defining open spaces between the molding elements;

positioning the molding mesh onto the surface;

depositing hot asphalt into the open spaces between the molding elements, and levelling the asphalt;

rolling over the mesh and asphalt to facilitate adherence of the asphalt to the surface and to mold and compact the asphalt about the mesh;

applying water to the surface of the asphalt while rolling to limit the heating and buckling, and sticking of the mesh; and after rolling removing the molding mesh from the asphalt.

2. The system of claim 1, wherein the material forming the mesh is elastic such that unevenness of the applied asphalt with thickness less than the depth of the of the pattern molding elements of the mesh does not interfere with the compaction of the asphalt upon rolling.

3. The system of claim 1, wherein the material forming the mesh has sufficient elasticity to provide some laterally widening of the pattern molding elements on the mesh surface when subjected to downward pressure against the asphalt surface, such that upon release of pressure the pattern molding elements of the mesh narrow to facilitate separation from the asphalt.

4. The system of claim 1, wherein the surface is rolled additionally after removing the molding mesh from the compacted asphalt to further finish the surface.

5. The system of claim 1, wherein the pattern molding elements are formed of rubber.

6. The system of claim 1, wherein excess asphalt material is removed from the top of the mesh prior to removal of the mesh.

7. The system of claim 1, wherein different areas of mesh are filled with differing levels of asphalt.

8. The system of claim 1, wherein different areas of mesh are filled with asphalt of different color.

9. The system of claim 1, wherein the surface is coated with an adhesive material, prior to depositing the asphalt, to enhance adhesion of the asphalt with the surface.

10. The system of claim 1, wherein sand is inserted into crevices formed in the asphalt after removal of the mesh.

* * * * *